US005406663A

United States Patent [19]

Chen

[11] Patent Number: 5,406,663

[45] Date of Patent: Apr. 18, 1995

[54] METHOD AND A STRUCTURE FOR QUICKLY ASSEMBLING ROAD FOUNDATION AND SUPPORTS

[76] Inventor: Kuo-chung Chen, No. 20, Alley 17, Lane 63, Fu-Te 1st Road, Hsi-chih, Taipei Hsien, Taiwan, Prov. of China

[21] Appl. No.: 139,423

[22] Filed: Oct. 20, 1993

[51] Int. Cl.[6] ..... E01D 19/02

[52] U.S. Cl. ..... 14/75; 14/77.3; 404/43; 404/82; 405/244

[58] Field of Search ..... 14/75, 77.3; 404/1, 404/17, 34, 41, 43, 82; 405/232, 244

[56] References Cited

U.S. PATENT DOCUMENTS 3,882,564 5/1975 Muller ..... 14/77.3

4,662,019 5/1987 Muller ..... 14/77.3 X

*Primary Examiner*—Ramon S. Britts

*Assistant Examiner*—James A. Lisehora

*Attorney, Agent, or Firm*—Helfgott & Karas

[57] ABSTRACT

This invention relates to a method and structure for quickly assembling road foundation and support of this invention, comprising the following steps (1) first, selecting positions spaced from each other at an appropriate distance for placing the foundation along a road above which an elevated road will be constructed; then digging a groove having appropriate size in the ground surface of each selected position for horizontally placing the foundation and the road asphalt; (2) digging a recess having appropriate dimensions along the periphery of said groove for placing a horizontal supporting frame, and spraying the asphalt adhesive on the recess; (3) mounting the horizontal supporting frame on the recess, and filling the space above a horizontal flange extending outward along the the periphery of the bottom of the horizontal supporting frame with asphalt such that the top surface of the filled asphalt is flush with the top of the horizontal supporting frame; (4) then fully spraying the adhesive on the combination formed in step (3), and then horizontally placing the foundation such that the periphery of the foundation can be fixed on the top of the horizontal supporting frame; (5) connecting the vertical supports on the foundation; (6) finally, placing the road asphalt.

8 Claims, 8 Drawing Sheets

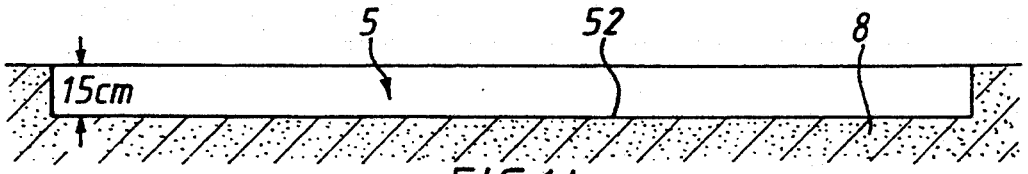
FIG,1A
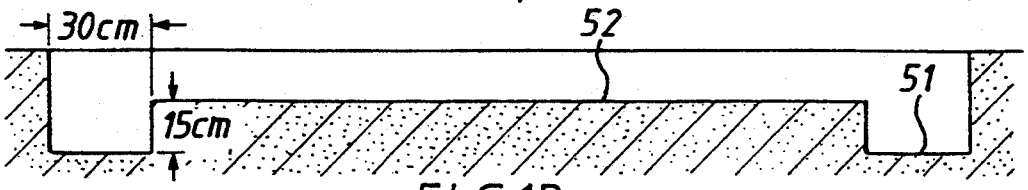
FIG,1B
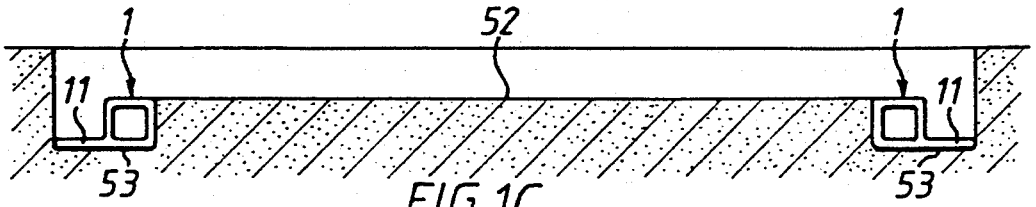
FIG,1C
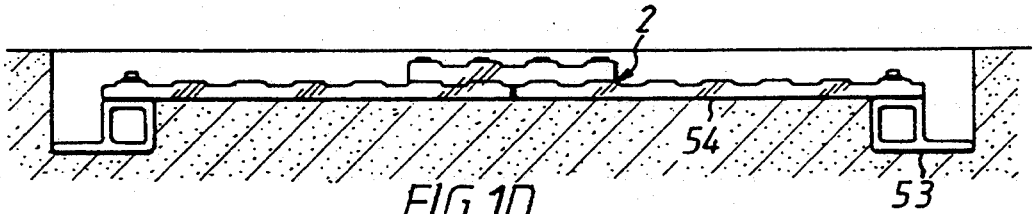
FIG,1D
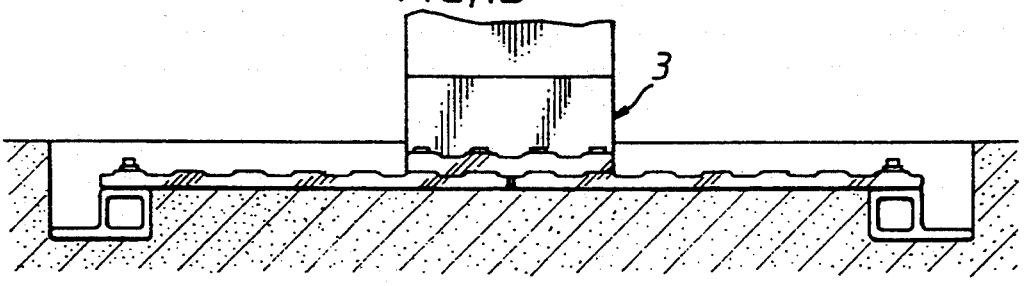
FIG,1E
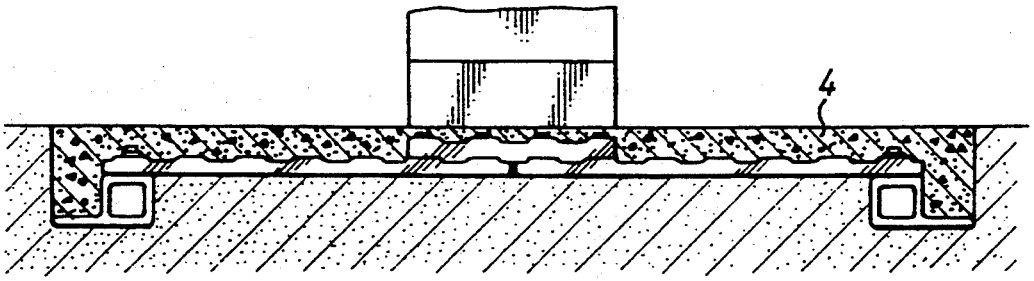
FIG,1F

METHOD AND A STRUCTURE FOR QUICKLY ASSEMBLING ROAD FOUNDATION AND SUPPORTS

BACKGROUND OF THE INVENTION

1. Field of the Invention

This invention relates to a method and a structure for quickly assembling road foundation and support, used for constructing an elevated road above a city road having large traffic.

2. Brief Description of the Prior Art

The conventional construction for foundation and support of the elevated road includes the following steps: (1) deeply placing foundation pile in site; (2) moulding pile cap; (3) pouring foundation with steel concrete; (4) moulding support or mounting support. Hence, it takes at least 30 days to complete the mounting of each support in site, which will cause serious problems in workers, materials transportation, traffic, or the business operation of store along the road to be constructed.

3. Summary of the Invention

The object of this invention is to provide a method and structure for quickly assembling road foundation and support without deeply placing the foundation in ground to accelerate the construction of an elevated road, and the method and structure of the invention will not destroy the appliance in the ground, and can assure the smooth traffic in the constructed road.

In particularly, according to the invention, the construction of one set of supports can be completed within four hours while using the conventional construction method, it must take at least 30 days according to statistics. Hence, it is not necessary for the method and structure of the invention to enclose a road to be constructed and the smoothness of the traffic can be assured.

According to the method and structure for quickly assembling road foundation and support of this invention, the construction steps include: (1) first, selecting positions spaced from each other at an appropriate distance for placing the foundation along a road above which an elevated road will be constructed; then digging a groove having appropriate size in the ground surface of each selected position for horizontally placing the foundation and the road asphalt; (2) digging a recess having appropriate dimensions along the periphery of the bottom of said groove for placing a horizontal rectangular supporting frame, and spraying adhesive on the recess; (3) mounting the horizontal supporting frame on the recess, said frame having a flange extending outward along the the periphery of the bottom of the horizontal supporting frame; making the top of the horizontal supporting frame be flush with the bottom surface of the groove; (4) after horizontal adjustment, fully spraying the adhesive on the frame and the bottom surface of the groove, and then horizontally placing the foundation such that the periphery of the foundation can be fixed on the top of the horizontal support or supporting flame; (5) connecting the vertical support or supports on the foundation; (6) finally, placing the road asphalt.

The aforesaid steps can be completed within four hours.

The detailed content of the method and structure for quickly assembling road foundation and support of this invention will be further explained by referring to the accompanying drawings.

BRIEF DESCRIPTION OF THE INVENTION

FIGS. 1A, 1B, 1C, 1D, 1E and 1F are sectional views for schematically showing the working steps of the method according to this invention;

DETAILED DESCRIPTION OF THE DRAWING

Figure 2:
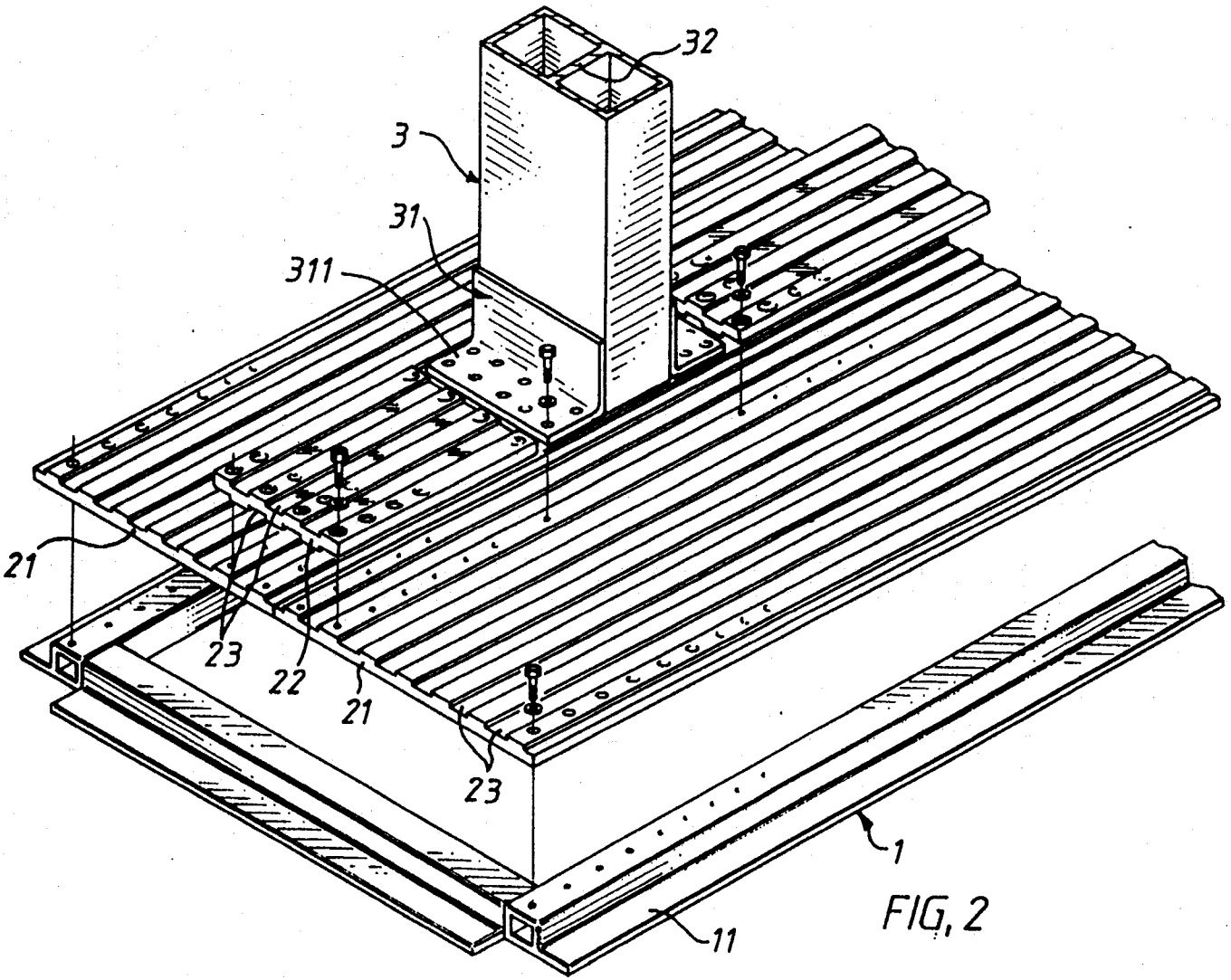
FIG. 2 is an exploded view showing the structure of this invention.
Figure 3:
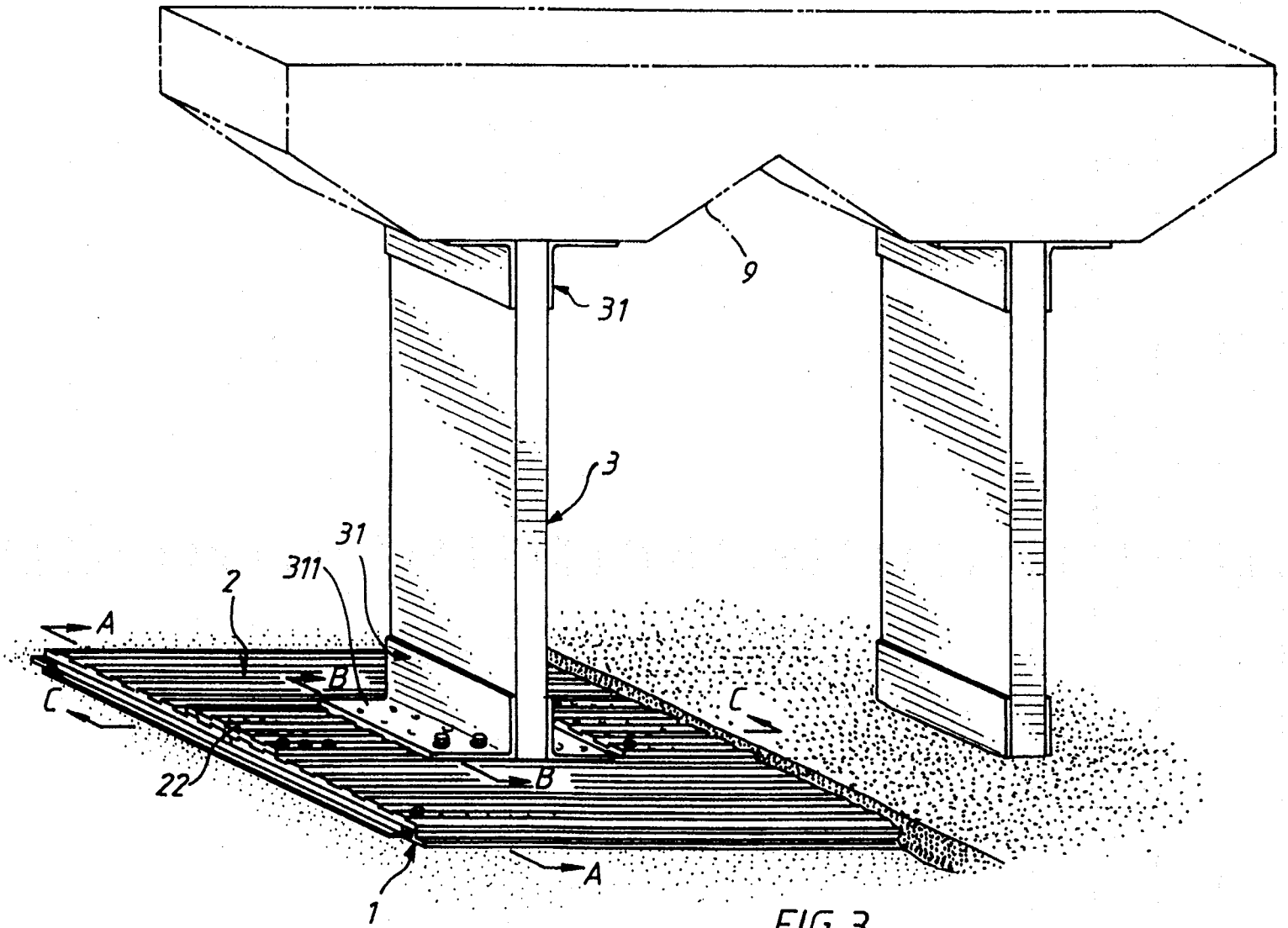
FIG. 3 is a perspective view of the structure of this invention.
Figure 4:
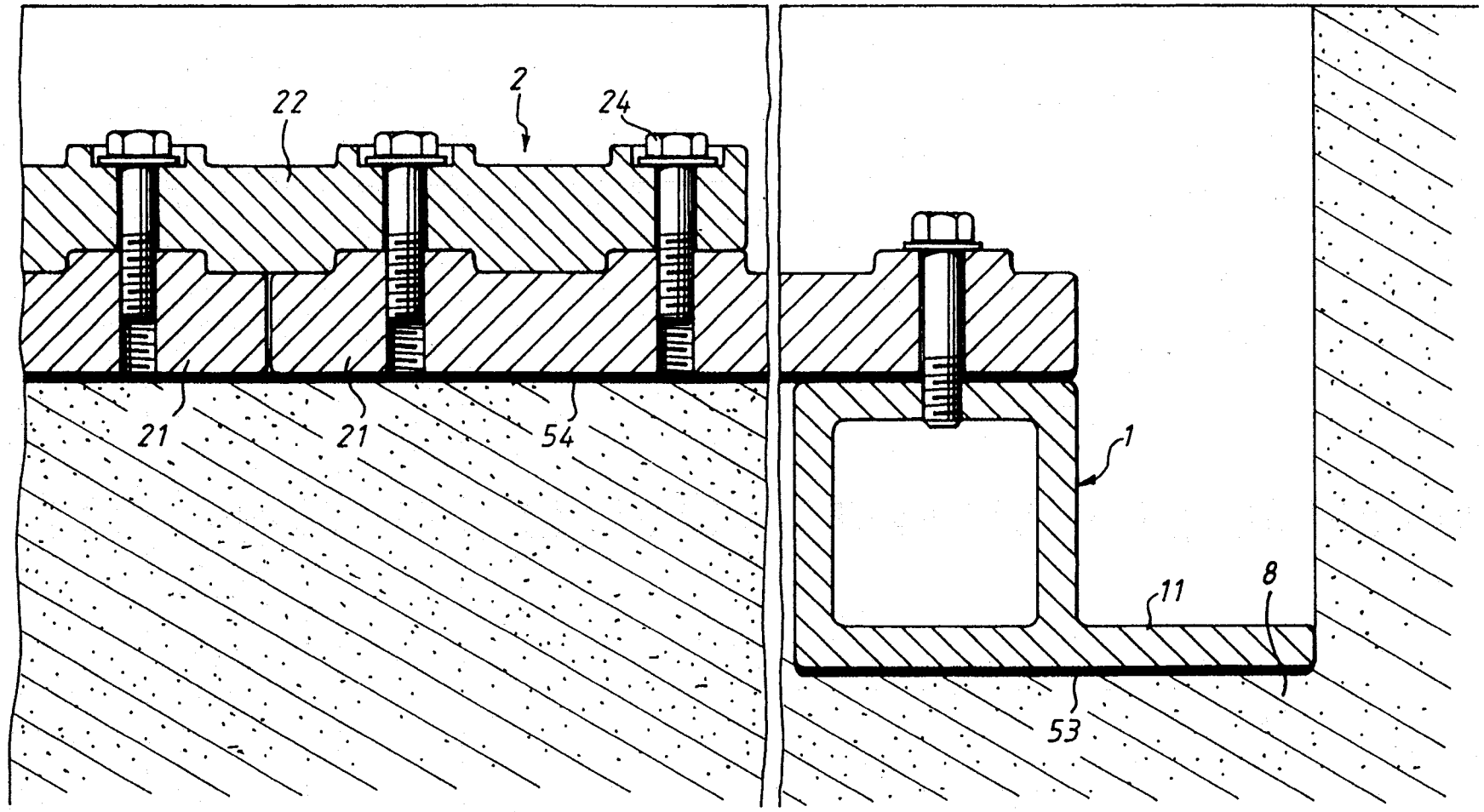
FIG. 4 is a partial sectional view of the structure of this invention along Line A—A of FIG. 3.
Figure 5:
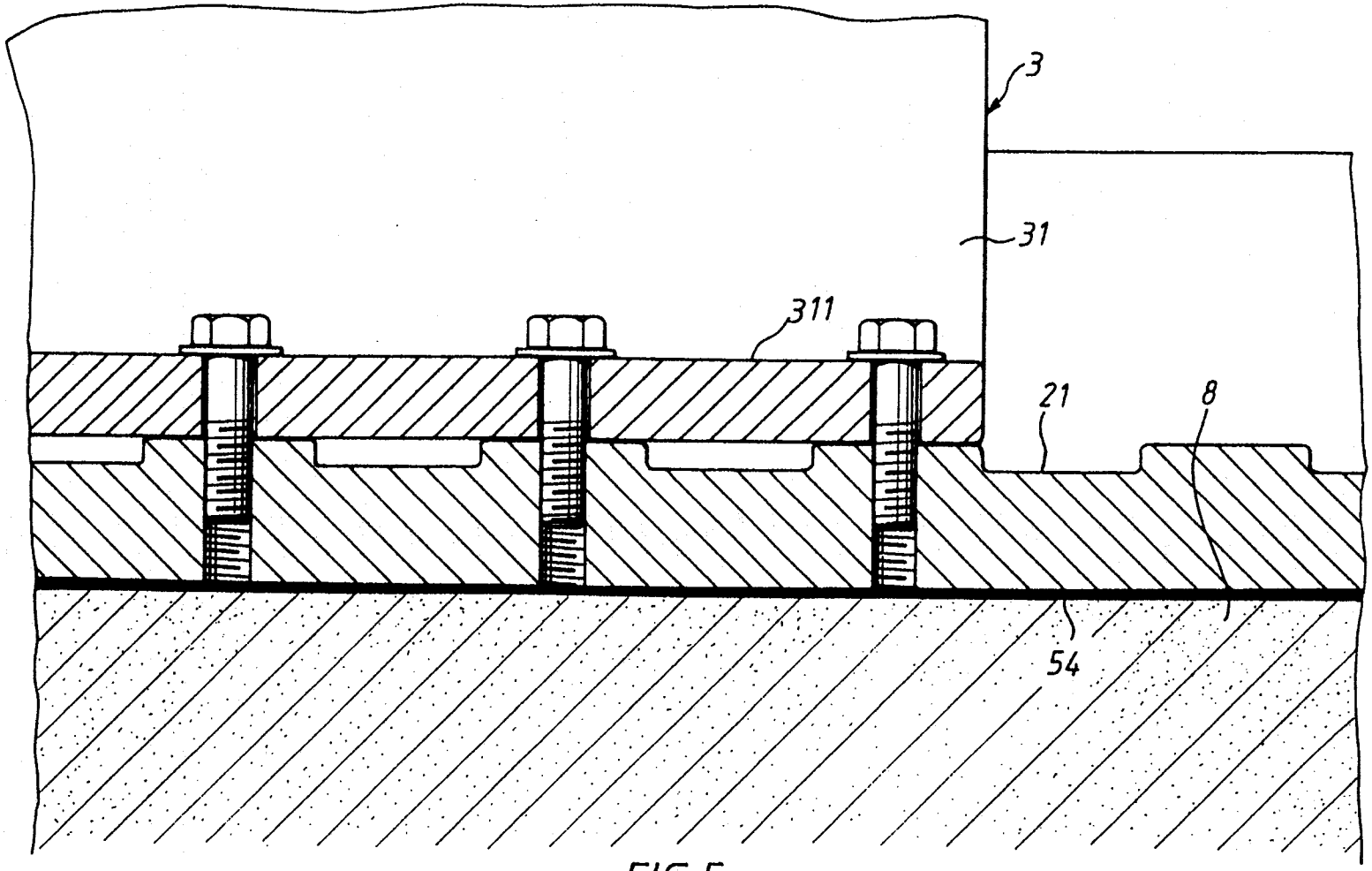
FIG. 5 is a partial sectional view of the structure of this invention along Line B—B of FIG. 3.
Figure 6:
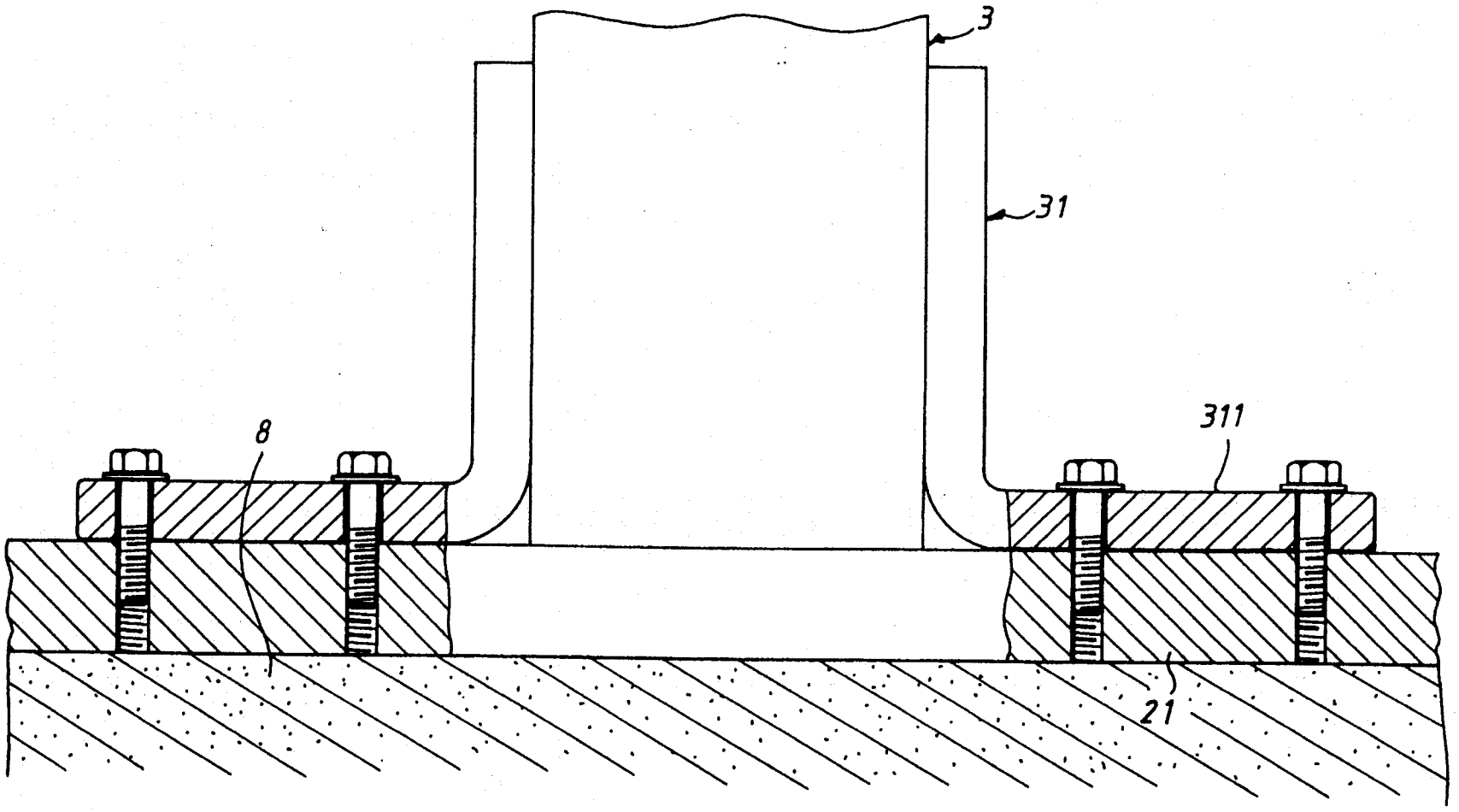
FIG. 6 is a partial sectional view of the structure of this invention along Line C—C of FIG. 3.

Please refer to FIGS. 1A–1F, 2, 4–6. The working steps of the method of this invention comprise:

(A) first, selecting positions spaced from each other at an appropriate distance (20m–40m) for placing the foundation (2) along a road above which an elevated road will be constructed; then digging a groove (5) having appropriate size in the ground surface of each selected position for horizontally placing the foundation (2) and the road asphalt (4), the depth of the groove (5) being about 10–20 cm, preferring 15 cm in the embodiment;

(B) digging a recess (51) having appropriate dimensions along the periphery of the bottom (52) of said groove (5) for placing a horizontal supporting frame (1), the depth of said recess (51) being about 10–20 cm and perferring 15 cm in the embodiment, and the width of said recess (51) being about 30 cm;

(C) spraying adhesive (53) on the recess (51) and mounting the horizontal supporting frame (1) on the recess (51), said frame (1) having a flange (11) extending outward along the the periphery of the bottom of the horizontal supporting frame (1); making the top of the horizontal supporting frame (1) be flush with the bottom surface (52) of the groove (5);

(D) after horizontal adjustment, then fully spraying the adhesive (54) on the frame (1) and the bottom surface (52) of the groove (5), and then horizontally placing the foundation (2) on said combination such that the periphery of the foundation (2) can be fixed on the top of the horizontal supporting frame (1);

(E) then connecting the vertical support or supports (3) on the foundation (2);

(F) finally, placing the road asphalt (4).

The structure of this invention will be described as follows.

Please refer to FIGS. 2, 3, 4–6. The structure of this invention mainly comprises a horizontal rectangular supporting frame (1), a rectangular foundation (2), and vertical supports (3); they are all made of metal, such as steel. Said horizontal supporting frame (1) is placed at the bottom of the structure, and each side of the horizontal supporting frame (1) has a rectangular (such as 15 cm×15 cm) section. A flange (11) having a width of 15 cm horizontally extends outward from the periphery of the bottom of the horizontal supporting frame (1). The width and the length of the horizontal supporting frame (1) respectively correspond to the width and length of the foundation (2).

Figure 7:
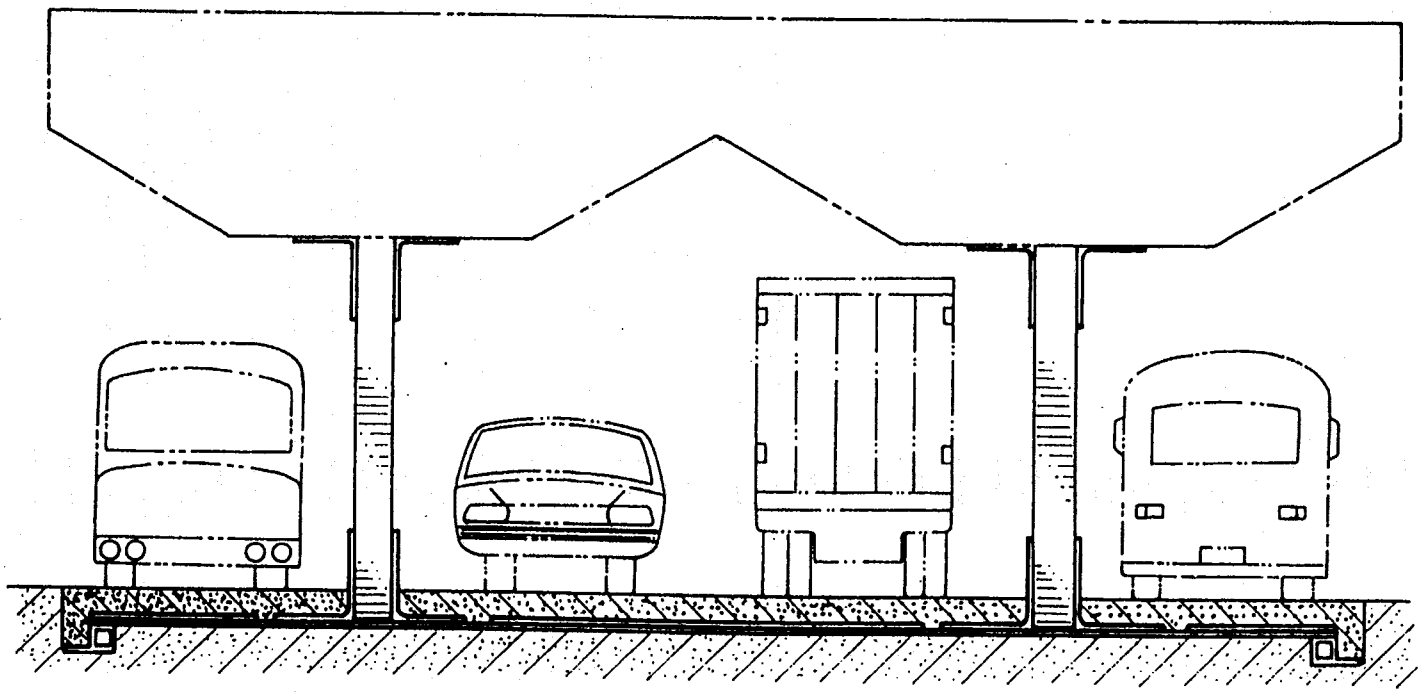
FIG. 7 is a schematic view showing the structure of this invention used in a road having four lanes.

The width of the foundation (2) is substantially equal to the height of the vertical support (3) and can not be less than 5m, and the length (L) of the foundation (2) can be calculated according to the following equation: L=N(number of road lanes)×3.3m+2m; for example, if a road having four lanes, then L=4×3.3m+2m, i.e., L=15m. The thickness of the foundation is within the range of 5 cm–10 cm. Please refer to FIG. 3 and FIG. 7 having four lanes. In the preferred embodiment, the area of the foundation (2) is 6m×15m, and for the convenience of manufacturing and transportation, the foundation (2) can be divided into two foundation portions (21), each having a area of 3m×15m. The foundation portions (21) are manufactured in plant and after they are transported to the work-site, they are connected together by means of plurality of connection plates (22) (such as three connection plates) by means of bolts (24) and spring washer. The surfaces of the foundation portion (21) contacted with the connection plates (22) and the two surfaces of the connection plates (22) are all provided with plurality of shallow grooves (23) (the depth and width of said shallow groove can be 1.5 cm and 10 cm, respectively) for preventing the road asphalt (4) on the foundation (2) from moving when heavy-duty car passes the road. Further, the thickness of the connection plate is substantially the same as that of the foundation.

The periphery of the assembled foundation (2) is fixed onto the top of the horizontal supporting frame (1) by means of bolts and spring washer. The function of the horizontal supporting frame (1) is to enhance the security on the road bed and increase the resistance of the periphery of the foundation (2) such that the foundation (2) can be subjected to the momentary impact of any heavy-duty čar.

The aforesaid connection plates (22) are spaced from each other at an appropriate distance such that the vertical supports (3) (such as two vertical supports) can be fixed between the connection plates (22) and on the foundation (2).

The vertical support (3) is provided with ducts (not shown) therein for water and electricity etc. (it is better to prepare space in the support). The two sides of the upper and lower ends of each vertical support are respectively provided with an L-shaped leg (31). The horizontal portion (311) of the L-shaped leg (31) is provided with many threaded holes. By connecting the horizontal portion (311) with the foundation (2) by means of bolts and spring washers, the vertical support (3) can be fixed onto the foundation (2). As to the upper end of the vertical support (3), it will be connected to a bridge girder (9); such connection is not in the domain of this invention and thus will not be discussed here.

Further, if the road bed is very soft, plurality of earthing nails (not shown) can be used as auxiliary means for fixing the foundation on the road bed.

According to the method and structure for quickly assembling road foundation and support, the foundation (or foundation portion and connection plates) and vertical support are manufactured in plants and then transported to the work-site. In the work-site, the foundation will be placed on the road bed and the vertical supports will be fixed on the foundation to form a base for constructing an elevated road. Since the method and structure of this invention does not need to deeply dig in the work-site and to perform the complicated process of deeply placing the foundation pier (these complicated process will be liable to destroy the underground appliance for water and electricity), the working steps of this invention can be completed in a very short time (about four hours) and does not need to enclose the road to be constructed, and thus the traffic on the road to be constructed will not be affected and will be smooth and the business operation of the store along the road to be constructed will not be also affected.

Further, since this application utilizes shallow foundation manner (20–40 cm), the underground equipment which can provide water and electricity will not be destroyed and can be further protected by the foundation (2) which can prevent the underground pipelines from being damaged by the pressure of the cars.

According to this invention, it is easy to control the quality of the elements of the assembly structure which are all made of steel when manufacturing these elements in the plant, and therefore, there is no creep which will affect the safety of the construction occurred in this invention. Besides, the finished products (elements of the structure of this invention) having certain specification can be stored and controlled and can be used repeatedly.

Figure 8:
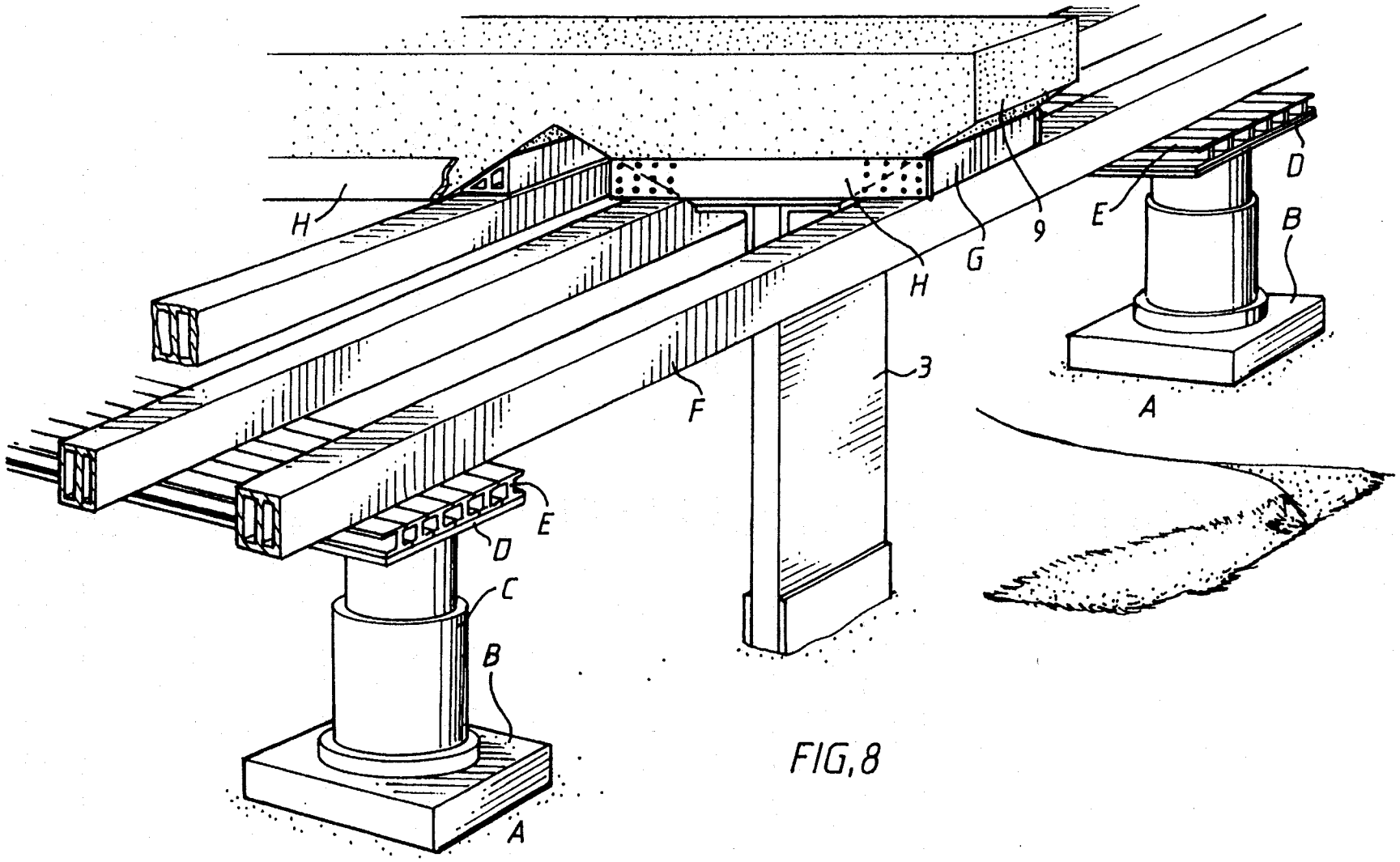
FIG. 8 is a schematic view showing the equipment for maintaining the foundation of the invention.

Further, if the foundation (2) slants or sinks due to the soil loss and thus will cause danger, the invention can also provide maintenance method for the foundation. Please refer to FIG. 8 concerning the maintenance equipment. The maintenance method includes the following steps: (1) selecting and measuring safe ground positions (A); (2) placing a packing-up block (B) having appropriate height; (3) placing an oil gravity jack (C); (4) placing a packing-up block (D) of steel plate having a thickness of 2 inches on the jack; (5) then placing plurality of I-shaped cross rails (E) of steel on the packing-up block (D); (6) placing two longitudinal rails (F) having a ⊟-shaped section on the I-shaped cross rafts (E); (7) placing horizontal triangular packing-up blocks (G) on the longitudinal rafts (F); (8) the ends of the horizontal triangular packing-up blocks being connected with bolt plate (H), then adjusting and aligning the height and horizontal and vertical positions of the jack (C); (9) the jack being slightly pressured such that the the triangular packing-up block (G) being against the slant face of the bridge girder (9) and be welded thereto; (10) the jack being pressured, after the safety of the road bed is assured, then the jack is pressured again to lift the bridge girder; then removing the asphalt on the foundation (2) and then dismounting the supports (3) and the foundation (2); after completing the repair of the road bed, then mounting the foundation and supports again. The aforesaid steps can be completed within 3–7 days. Therefore, the operation of the maintenance for the foundation is easy and quick.

EXAMPLE

If this invention is applied to a road having four lanes (please refer to FIG. 3 and 7), some data can be further provided in order to explain the praticalness of this invention.

1. The foundation (2) is adhered to the road bed (8) by means of the adhesive of resin mixed with asphalt. The standard for the adhesion is 350 $/m$^2$, and can bear the impact of any heavy-duty cars.

2. The foundation (2) can be made of JIS SS 41 # steel plate. Its thickness is 7.5 cm and said foundation (2) can be divided into two foundation portions (21), each having a area of 3m×15m. Three connection plates (22)

and two supports (3) are used in this case wherein the connection plates (22) are used to connect the two foundation portions (21) together by means of bolts of stainless steel and spring washers. The distance between two supports (3) is 7.6m for two lanes.

3. The support body is made of SM 41 # steel plate of which the thickness is more than 38 mm and the volume of the support body is 0.5m (width)×2m×5m (height) (the support body is reinforced by a longitudinal reinforced rib (32) (FIG. 2) in the middle of the support body). Regarding the constant safety load-carrying capacity of each support body, the bending strength is 4800 $, and the shearing strength is 10250 $. The L-shaped leg (31) is made of steel plate having a thickness of 5 cm and is welded or riveted to the support body. The bending strength for the legs on each end of the support body is more than 3500 $. The whole support (3) must be tested by vertical pressure of 3000 $ and be subjected to anti-corrosive treatment.

4. The horizontal supporting frame (1) is made of SM 41 # steel plate having a thickness of 30 mm and is fixed to the periphery of the bottom of the foundation (2); the function of the horizontal supporting frame (1) can enhance the fixation of the foundation and increase the edge load of the foundation to 200 $/in$^2$. Its supporting force is higher than 350 $/m$^2$. Since the height of the support (3) is equal to the width of the foundation, then the minimum area of the foundation for mounting a support is 36m$^2$ and can bear the maximum load of 12600 $ on the elevated road having two lanes. The distance between the threaded holes on the top of the horizontal supporting frame (1) can not be larger than 50 cm in order to meet the requirement for safety design (200 $/in$^2$).

5. The connection bolts used in this invention are made of M32 P2 stainless steel having a tensile strength which is at least 45 kg /mm$^2$, and thus the tensile strength for each bolt is 33 $. Since the stainless steel includes Cr (17%) and the shearing strength is 38 kg /mm$^2$, the shearing strength for each bolt is 28 $. Each foundation portion can be connected with 279 bolts and thus tensile strength and shearing strength for each foundation portion are 9207 $ and 7812 $, respectively.

6. In the aforesaid step (A) of the assembling method of the invention, if the distance between the positions for placing the foundation (2) is 20m, the maximum momentary load on the road is 1760 $ (including the momentary maximum impact from heavy-duty car). Therefore, there is 880 $ load on each support (3). The area of force dispersion of each support is 5m$^2$, and actual transmitted load for each support is 180 $/m$^2$. Since the foundation (2) is made of JIS SS 41 # steel plate having the thickness of 7.5 cm and its safety load is 5000 $/mm$^2$, 180 $/mm$^2$ can be easily transmitted. Further, the foundation (2) can be also provided with man hole etc. The safety of the appliance on the foundation (2) can be assured even if a hole having a diameter of 3m is formed in the road bed under the foundation due to the loss of the soil of the road bed.

I claim:

1. A method for quickly assembling road foundation and support, comprising the steps of:

(A) first, selecting positions spaced from each other at an appropriate distance for placing the foundation along a road above which an elevated road will be constructed; then digging a groove having appropriate size in the ground surface of each selected position;

(B) digging a recess having appropriate dimensions along the periphery of the bottom of said groove;

(C) spraying adhesive on said recess and mounting a horizontal supporting frame on the recess; making the top of said horizontal supporting frame be flush with the bottom surface of said groove;

(D) after horizontal adjustment, then fully spraying the adhesive on said frame and the bottom surface of said groove, and then horizontally placing a foundation on said combination such that the periphery of the foundation can be fixed on the top of said horizontal supporting frame;

(E) then connecting vertical support or supports on said foundation;

(F) finally, placing the road asphalt.

2. A method for quickly assembling road foundation and support as claimed in claim 1 wherein the depth of said groove is within the range of 10 cm–20 cm.

3. A method for quickly assembling road foundation and support as claimed in claim 1 wherein the depth of said recess is within the range of 10 cm–20 cm and the width of said recess is about 30 cm.

4. A structure for quickly assembling a road foundation and a support, comprising a horizontal rectangular supporting frame, a rectangular foundation, and at least one vertical support;

said horizontal rectangular supporting frame having four elongated side members forming a bottom of the structure, each of said four side members having a square cross section and a flange horizontally extending outward therefrom;

said foundation having a top surface and shallow grooves on said top surface, said foundation being placed on the horizontal rectangular supporting frame; the foundation having a periphery which is fixed onto a top surface of the horizontal rectangular supporting frame;

said at least one vertical support having an upper end with two sides and a lower end with two sides, the two sides of the upper and lower ends each being respectively provided with an L-shaped leg having a horizontal portion; said at least one vertical support being fixed onto said foundation by connecting the horizontal portion of at least one of the L-shaped legs to the foundation.

5. A structure for quickly assembling a road foundation and a support as claimed in claim 4 wherein the horizontal supporting frame has a width and a length and said foundation has a width and a length; said flange has a width of about 15 cm; and the width and the length of the horizontal supporting frame respectively correspond to the width and length of the foundation.

6. A structure for quickly assembling a road foundation and a support as claimed in claim 5 wherein the width of the foundation is substantially equal to a height of the vertical support and is not less than 5m, and the length (L) of the foundation is calculated according to the following equation: L=number of road lines×3.3m+2m; and the thickness of the foundation is within the range of 5 cm–10 cm.

7. A structure for quickly assembling a road foundation and a support as claimed in claim 6 wherein the foundation is divided into 2 or 3 foundation portions along the width of the foundation for the convenience of manufacturing and transportation, said top surface of the foundation comprising top surfaces of the foundation portions; said foundation portions being connected together by means of a plurality of connection plates;

the top surfaces of the foundation portions contacting with the connection plates and the connection plates having two surfaces, the top surfaces of the foundation portions and the two surfaces of the connection plates all being provided with a plurality of shallow grooves for receiving road asphalt and for preventing road asphalt from moving on the foundation when a heavy-duty car passes over the foundation.

8. A structure for quickly assembling a road foundation and a support as claimed in claim 7 wherein the thickness of the connection plate is substantially the same as that of the foundation.

* * * * *